US006850139B1

(12) United States Patent
Dettmann et al.

(10) Patent No.: US 6,850,139 B1
(45) Date of Patent: Feb. 1, 2005

(54) SYSTEM FOR WRITING MAGNETIC SCALES

(75) Inventors: Fritz Dettmann, Wetzlar (DE); Uwe Loreit, Wetzlar (DE); Carsten Möller, Giessen (DE); Torsten Schönbach, Oberstiefenbach (DE)

(73) Assignee: Imo Institut fur Mikrostrukturtechnologie und Optoelektronik E.V., Weltzlar (DE)

( * ) Notice: Subject to any disclaimer, the term of this patent is extended or adjusted under 35 U.S.C. 154(b) by 0 days.

(21) Appl. No.: 09/936,087

(22) PCT Filed: Mar. 3, 2000

(86) PCT No.: PCT/EP00/01859

§ 371 (c)(1),
(2), (4) Date: Apr. 24, 2002

(87) PCT Pub. No.: WO00/54293

PCT Pub. Date: Sep. 14, 2000

(30) Foreign Application Priority Data

Mar. 6, 1999 (DE) ..... 199 09 889
Aug. 25, 1999 (DE) ..... 199 40 164

(51) Int. Cl.[7] ..... H01F 13/00
(52) U.S. Cl. ..... 335/284; 361/143; 361/152; 361/155; 361/156

(58) Field of Search ..... 335/284; 361/143–156

(56) References Cited

U.S. PATENT DOCUMENTS 4,734,816 A * 3/1988 Guillemin et al. ..... 361/149
5,684,444 A * 11/1997 Becker et al. ..... 335/284

FOREIGN PATENT DOCUMENTS

DE 907804 C * 3/1954

* cited by examiner

*Primary Examiner*—Ramon M. Barrera
(74) *Attorney, Agent, or Firm*—Koda & Androlia

(57) ABSTRACT

The invention relates to a system for pulse magnetizing high-precision magnetic scales. The system comprises a shaped current conductor (1) and a pulse current source (2) that is composed of a capacitor bank (3), a transfer switch (4) and a control unit (5). The compact set-up of the system is the prerequisite for a power circuit that has such a low resistance that the required high pulse currents are obtained at supply voltages of below 60 V. The transfer switch is an H bridge with four switches (7) that contain equal numbers of MOS transistors connected in parallel. The short pulse times that are achieved using the MOS transistors allow the use of shaped current conductors with which magnetized areas can be produced with a very high precision. The inventive system provides a means for saving components, electric power and time by a factor of up to 100.

28 Claims, 4 Drawing Sheets

SYSTEM FOR WRITING MAGNETIC SCALES

The present invention relates to a system for magnetizing magnetic scales sequentially by sections, which is called writing. Magnetic scales are needed for determining length, angle, and position. They can be magnetized with periodically repeating separations or by sections in the opposite direction according to different codes. Magnetic scales can be linear or circular or of any other shape. They can consist entirely of magnetically hard material or of magnetically hard material which is located on a magnetically soft or non-magnetic substrate. The surface can be protected by a coating. Systems are known for writing magnetic scales according to two different principles. According to the first principle (German Patent Application Pre-Examination Publication No. DE 41 08 923 A1), an electrical conductor is shaped in such a way and put in the immediate vicinity of the magnetic scale that a pulse of current flowing through it produces a magnetic field which extends over the entire scale or at least a substantial section of it and which has a spatial distribution and strength so that it produces magnetization in the shape of the intended magnetic pattern. The disadvantage of this method of magnetizing magnetic scales is that the position of the parts of the shaped electrical conductor must have very high precision requirements placed on them which go beyond the precision requirements of the magnetic scale, since the transfer of the intended magnetic pattern is not possible without errors. The shaped electrical conductor is produced mechanically, so that it is not possible to achieve positional errors with the scale produced in this way that are on the order of a few microns.

If the scale is magnetized in sections that contain several areas which are supposed to be magnetized to different extents, then there is an additional accuracy problem at the interfaces of each two sections that are magnetized one after the other. The lack of precision results less from the error of the measured positions of the shaped electrical conductor than from the fact that magnetic fields with a strength exceeding the coercive field strength of the scale material are also produced outside the section which the electrical conductor is occupying. Thus, the scale is also magnetized here. Because of magnetic hysteresis, that is because the magnetization direction that is finally produced in the scale material depends on its prior history of magnetization, the interfaces have areas of erroneous magnetization, which then limit the accuracy of the magnetic scale.

Other disadvantages of the above principle result from the structure of the source of current pulses (e.g., German Patent Application Pre-Examination Publication No. DE 34 21 575 A1) of such magnetization devices. These sources of current pulses provide current amplitudes of up to about 30 kA, are operated with high voltage, have masses of more than 50 kg, and are relatively expensive. The high voltage means that relatively rigid supply lines must be used between the source of current pulses and the shaped electrical conductors. These supply lines make precise positioning difficult, since they transfer forces and vibrations to the shaped electrical conductor. These forces and vibrations are also mostly produced by the strong current pulse for magnetization, which, at 30 kA, generates considerable forces for a short period of time.

The second principle for writing magnetic scales is disclosed in German Patent Application Pre-Examined Publication No. DE 44 42 682. Here a writing head consists of one or two magnetic poles which are separated by a narrow gap and which are surrounded by at least one coil. The magnetically soft pole can be magnetized up to saturation by a current through the coil. Currents of less than 1 A are sufficient for this purpose, since the number of winds of the coil can be correspondingly adjusted. At the end of the one-pole system or near the gap of the two-pole system magnetic field strengths then occur which are sufficient to magnetize the scale material. In the case of the two-pole system, the gap is passed directly over the scale that is to be magnetized. Here the magnetic field exits from the magnetically soft material on one side of the gap and reenters on the other side of the gap. In the area of the scale where the field strength of the exiting magnetic field is greater than the coercive field strength of the scale material, the scale is magnetized in the direction of the magnetic field that is present at that time. However, this is opposite on the two sides of the gap. Therefore, as the position of the writing head progresses, an area which is already magnetic always has to be remagnetized. This is disadvantageous, since the size of the area that is finally magnetized in a certain direction is determined by the field strength produced by the writing head and also by that produced by the already magnetized scale material. Thus, the errors of two magnetization processes are added. These errors are also not necessarily small, since the strength of the magnetic field which exits from the writing head decreases with a relatively small gradient as the distance from the gap and from the magnetically soft poles increases. Thus, small fluctuations in distance ultimately have the effect of producing considerable differences in the length of the magnetized areas. The most favorable case of operation still appears to be when the writing head directly touches the surface of the scale. However, this is also not optimal for high precision of the scale, due to the different coefficients of friction in the movement of the writing head with respect to the scale, which produce positioning errors.

When it is desired to produce, on a circular scale, poles of equal length which have the opposite magnetization direction in alternation over the entire 360°, difficulties occur in any case if a writing head with a gap is used, due to the opposite field direction on the two sides of the gap, when the initially magnetized areas are once again reached after the circular scale is rotated by about 360°. Then this joint always has a great error in the position of the areas of magnetization.

It is true that the use of a single magnetic pole with a coil does improve the field distribution, since the magnetic field component exiting perpendicular to the surface of the pole has an absolute maximum only in the middle of this surface. The relatively small decrease in magnetic field strength transverse to the field direction, and a strong decrease with the distance from the surface of the pole means that here again the distance between the surface of the pole and the scale surface has to be maintained with great precision. The necessity of remagnetization processes near the edge of the areas of constant magnetization that are to be produced cannot be excluded. The disadvantages of keeping the intended position when using the touching mode of operation that is preferred in practice are also present here.

Another disadvantage of keeping a precise position of the writing head with respect to the scale when using magnetically soft magnetic poles which are magnetized by current in a coil results from the fact that there are forces between the magnetic poles and the already magnetized areas of the scale, which are of considerable size, due to the small distances which are necessary.

Accordingly, the object of the present invention is to provide a system which is suitable for writing magnetic scales, which produces magnetic areas with highly precise dimensions, and which produces a precise repetition of the magnetization within the magnetic areas that is highly repeatable.

The object is accomplished by the system described in the main claim, and advantageous embodiments are described in the dependent claims.

The system for writing magnetic scales of the present invention comprises a shaped electrical conductor for producing magnetic fields at the site of the scale and a source of current pulses for both current directions and further comprises a capacitor bank, a change-over switch, and a control unit. All such components are integrated in a compact unit. The compact construction keeps the total current path from the capacitor bank to the shaped electrical conductor extremely short. All components and connection wires are mounted at a fixed position relative to one another, so that the forces which could change the position of the shaped electrical conductor relative to the scale that is to be magnetized do not have any affect. The short current path and a large cross section of the lines between the capacitor bank and the shaped electrical conductor ensure low resistance in the entire circuit. Therefore, an operating voltage in the low-voltage range is sufficient to produce a high current which is necessary for the magnetization.

A small cross section which is bordered exclusively directly on the shaped electrical conductor which produces the magnetic field does not produce current-limiting resistance, due to the short length of the shaped electrical conductor, but is a prerequisite for allowing the center of the shaped electrical conductor to be positioned very close to the surface of the scale. This ensures that high magnetic field strengths are produced in the scale material.

Since the dimensions of the shaped electrical conductor are adapted to the dimensions of the areas to be magnetized, the current in the shaped electrical conductor always produces a magnetic field distribution which makes two or more remagnetizations of the scale material impossible. To write scales with periodic magnetization in which the pole length is substantially smaller than the track width, hairpin-shaped electrical conductors are used whose conductor spacing is substantially greater than the wire diameter. The field strength of the field component acting perpendicular to the scale surface has its maximum in the area between the centers of the two wires. Somewhat beneath the centers there is an extremely strong field gradient, since here the perpendicular field component changes its sign. A current pulse passing through this hairpin-shaped electrical conductor magnetizes the scale in one direction in the area beneath the line connecting the centers of the wires, and magnetizes it in the other direction immediately adjacent to it. If, as intended, the length of the area beneath the line connecting the wires coincides with centers with the pole length, then it is not necessary to change the magnetization direction of the magnetic material, once it is set. There are only magnetization processes with the same magnetization direction for every area of the scale. This fact and the high field gradient ensure high precision of the length and field strength of the poles, if the shaped electrical conductor has been positioned with a correspondingly precise measurement system. This also applies for the case in which the shaped electrical conductor is located a distance above the surface of the scale, to avoid errors due to the forces of friction.

If the separation of the two parts of the hairpin-shaped electrical conductor is greater, it is advantageous to select a rectangular cross section that has two or more round wires arranged in it. This produces a higher magnetic field strength and better homogeneity of the magnetic field beneath the surface of the hairpin-shaped electrical conductor, without this reducing the field gradient beneath the cross section of the conductor.

If the track width of the scale is only slightly larger than the pole length, a rectangular-shaped electrical conductor is used. Here again, if there are two or more wires in a rectangular cross section it is possible to achieve an advantageous high magnetic field strength and good field homogeneity with high field gradients under the center of the conductor cross section.

To write scales whose magnetization must run parallel to the surface of the scale, shaped electrical conductors with a band-shaped cross section are used, with the band thickness being selected as small as possible so that all the current is concentrated at the smallest distance from the surface of the scale and produces high magnetic field strengths. The width of the cross section is adapted to the length of the areas to be magnetized, so that the area is magnetized with a pulse of current. The shaped electrical conductor can also consist of a number of wires lying directly adjacent to one another, which then together fill the band-shaped cross section and have parallel currents flowing through them. It is advantageous for the cross section of the band to be thicker at the two edges than in the middle part, or to use wires with a greater diameter at the edge, since this produces a more homogeneous field distribution in the area to be magnetized and makes the magnetic field strength drop off more sharply at the edge of this area.

Independent of the special shape, the shaped electrical conductor is always fixed in a holder, so that the forces occurring during the current pulse cannot make any change either in its shape or in its position relative to the scale. The holder with the shaped electrical conductor is interchangeable, so that it is always possible to use the electrical conductor that has the optimal shape for writing the respective scale.

The change-over switch of the source of current pulses has the form of an H bridge. This allows current pulses from the capacitor bank having the same amplitude and the same behavior over time but the opposite direction to be sent into the shaped electrical conductor, which is a prerequisite for having pole lengths of the opposite magnetization direction in a periodic scale which also coincide with high precision. It is preferable for the H bridge to use MOS transistors as switches, and all switches should consist of an equal number of parallel MOS transistors. This will achieve a sufficiently large total current strength and the resistance of the parallel MOS transistors will not limit the current in the circuit. It is important that the compact structure of the system produces inductances in the circuit that are so small that the current through the shaped electrical conductor rises to its maximum value in a few tenths of a microsecond. The MOS transistors can be blocked again by a signal from the control unit a few microseconds after the beginning of the current pulse, since this time duration is sufficient for magnetization. This pulse duration that is very short in comparison with the state of the art, gives the system according to the invention many advantages. One advantage consists of the fact that during the short pulse the voltage at the capacitor bank drops by only a small amount. This means that economical electrolytic capacitors are used which have a high capacitance per volume, and help keep the structure of the entire system compact and its dimensions small. Another advantage is that the small charge of the capacitor bank removed by the pulse current can be fed back again by a small current in the pulse pauses, and only a small power has to be applied to supply the system. Furthermore, the short pulse duration allows a high repetition rate, so that it is possible to achieve high writing speeds which are limited by the process of positioning the system relative to the scale, rather than by the pulse repetition frequency that is possible. The short pulse duration means that only a small amount of electrical power is converted into heat in the shaped electrical conductor. Small cross sections can be used for the electrical conductor, without it being necessary to fear thermal decomposition. The small cross sections make possible higher magnetic fields in the area of the scale, since the distance of the currents to the scale surface can be kept very small.

According to the present invention, the source of current pulses is located in a protective shield made of a metal that is a good conductor. The only unshielded part is the holder with the shaped electrical conductor, which has the supply lines for carrying the current back and forth on it, which however, are right next to one another. This makes the environment of the system free of interfering or health-endangering electromagnetic fields, despite the high currents.

The systems according to the invention are intended for writing magnetic scales whose magnetization direction periodically alternates in the direction of measurement and magnetic scales with magnetization areas whose lengths are assigned to a code. When such systems are used, it is intended for the shaped electrical conductor to be positioned over the surface of the scale without making contact with it, so that friction between the shaped electrical conductor and the scale surface, which could cause positioning errors, is excluded.

The present invention is described below in detail on the embodiments with reference to the accompanying drawings wherein.

Figure 1:
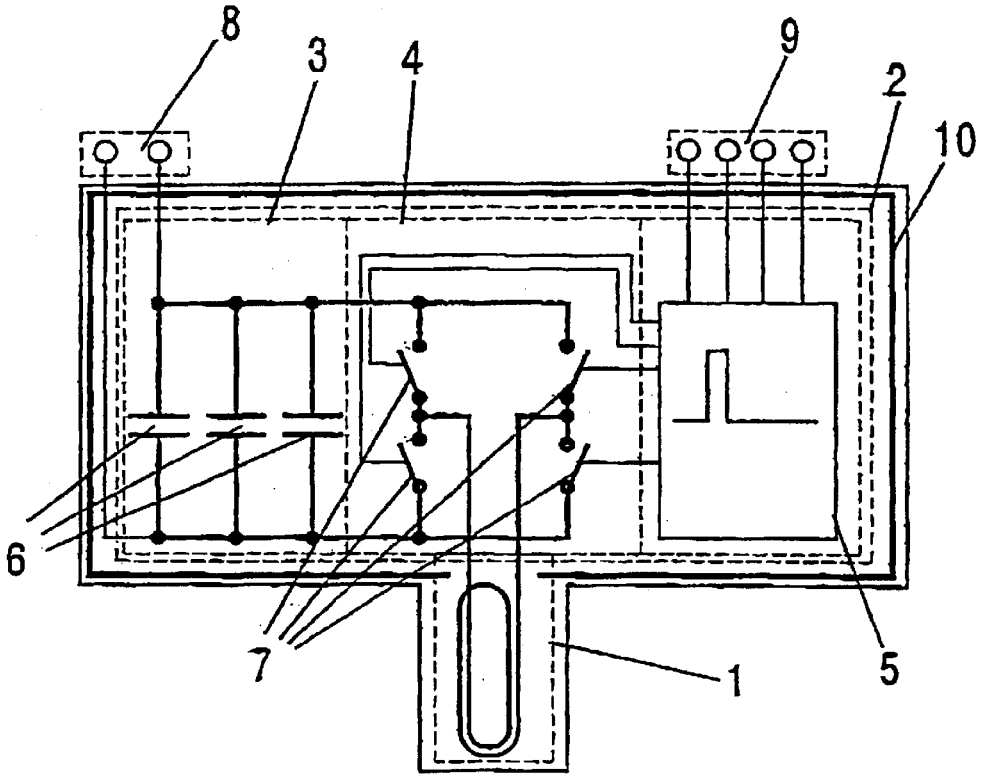
FIG. 1 is an overview of the system according to the invention.

FIG. 1 shows an overview of the entire system for writing magnetic scales according to the present invention. The system for writing magnetic scales consists of a shaped electrical conductor 1, which is located near the surface of the scale during writing. Current pulses, which are formed in a source of current pulses 2, are fed into the shaped electrical conductor and produce magnetic field strengths near it which are sufficient to magnetize the scale material. The source of current pulses 2 consists of a capacitor bank 3, a change-over switch 4, and a control unit 5. The structure of the system is designed in such a way that there is a minimal line length with maximum possible line cross section between the capacitor bank 3 and the shaped electrical conductor 1. This ensures a very low-resistance connection, which is a prerequisite for high field strengths with low operating voltage of the capacitor bank 3. The operating voltage is fed through contacts 8. The voltage supply and input data line for control unit 5 pass through contacts 9.

The change-over switch 4 has the form of an H bridge. Four switches 7 are present, each of which consists of equally many parallel MOS transistors. This ensures that the switches 7 have sufficient current-carrying capacity and sufficiently low resistance. The special advantage of using MOS transistors over the thyristors or ignitrons that have been used up to now is that they can be switched at any time by pulses from the control unit 5 from the conducting state back into the blocked state. Thus, the pulse duration can be limited to a few microseconds. This time duration is sufficient in any case to magnetize the scale material. A longer pulse duration does not have any positive effect for the magnetization because the current strength of the pulse decreases with time. Because of the short pulse duration capacitor bank 3 is discharged only by a slight fraction with each individual pulse. Therefore, capacitor bank 3 is built of parallel electrolytic capacitors 6. Voltages in the low-voltage range of less than 60 V are sufficient for the operating voltage. This low voltage and the fact that electrolytic capacitors 6 can be used makes the volume that is required for the necessary capacitance especially small, which is quite appropriate for the low impedance of the circuit. Since capacitor bank 3 is only partially discharged by about 5%, the operating current is correspondingly small and can be under 500 mA. Furthermore, the thermal load on the shaped electrical conductor is small, due to the small pulse duration, so that it is possible to use small cross sections, which produce high magnetic field strengths in the area of the scale material. Finally, the short pulse duration makes possible high pulse repetition frequencies of about 50 $s^{-1}$, which makes the writing process more economical. The entire source of current pulses 2 is located in a metal shield 10, so that despite the high currents and the short operating times, no health-endangering electromagnetic fields exit from it.

Figure 2:
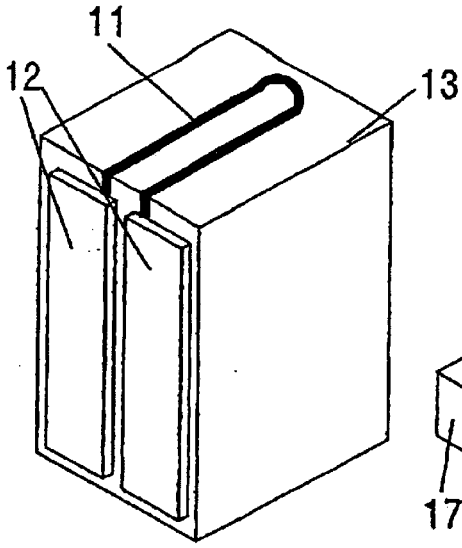
FIG. 2 shows a shaped electrical conductor with holder.

The form and dimensions of shaped electrical conductor 1 are adapted to the magnetic pattern that is supposed to be written on the scale. FIG. 2 shows a hairpin-shaped electrical conductor 11 with the supply lines 12 on a holder 13. The hairpin-shaped electrical conductor 11 is put into holder 13 and solidly glued in. The supply lines 12 are also solidly connected with holder 13, and are also located directly adjacent to one another. This prevents the hairpin-shaped electrical conductor 11 from changing its position relative to the scale as a result of the current pulse. The small separation of the two supply lines 12 means that no substantial stray electromagnetic field is present, despite the fact that holder 13 is located outside of shield 10.

Figure 3:
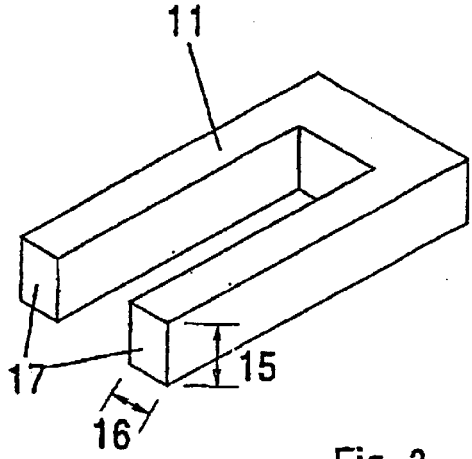
FIG. 3 is a hairpin-shaped electrical conductor.
Figure 4:
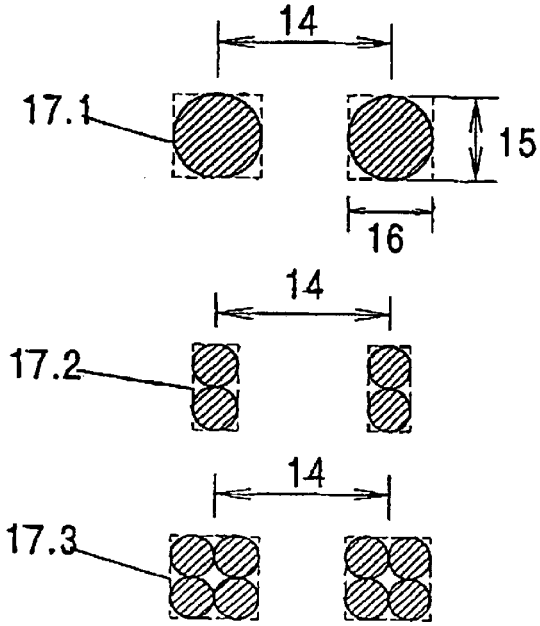
FIG. 4 is a cross section of hairpin-shaped electrical conductor.

FIG. 3 shows an enlarged picture of hairpin-shaped electrical conductor 11. The rectangular cross section 17 of electrical conductor 11 has linear dimensions 15 and 16. As shown in FIG. 4, this cross section 17 can be occupied by a circular conductor cross section 17.1, two circular conductor cross sections 17.2, or four circular conductor cross sections 17.3. If several conductor cross sections are present, they have currents flowing through them in the same direction. This is made possible by connecting the individual hairpin-shaped electrical conductors in series. The drawing with cross section 17.2 corresponds to shaped electrical conductor 1 in FIG. 1, for example.

Figure 8:
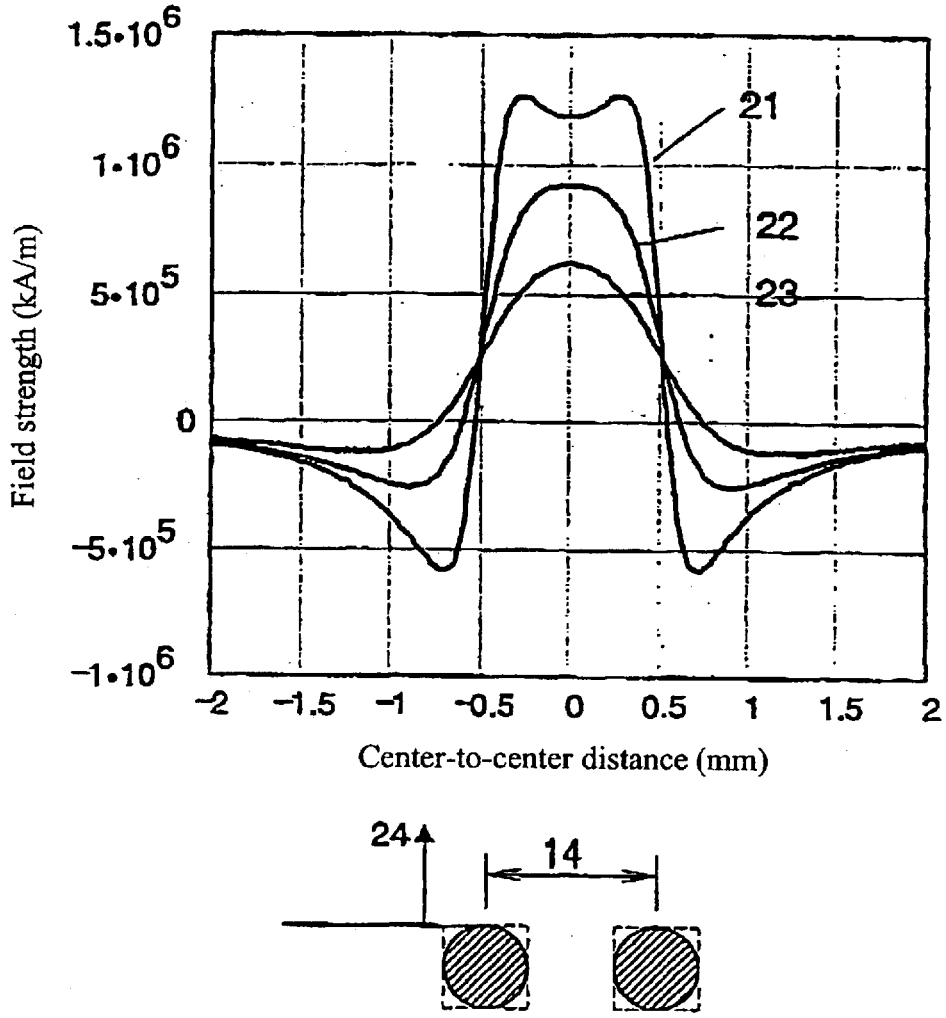
FIG. 8 is a behavior of magnetic field.

The separation 14 of the two cross sections 17 of hairpin-shaped electrical conductor 11 is substantially greater than the dimensions 15, 16 of cross section 17. FIG. 8 shows, for a center-to-center distance 14 of 1 mm, a wire diameter of 0.3 mm, and a current of 2,200 A, the field strength of the field component projecting perpendicular to the plane of the hairpin-shaped electrical conductor 11 plotted against the distance from the middle of the hairpin-shaped electrical conductor 11 for various distances 24. Curves 21, 22, and 23 are for the distances 0.05 mm, 0.2 mm, and 0.4 mm, respectively. Especially for smaller distances 24, a very sharp drop-off in field strength can be seen approximately in the area above the centers of the conductor cross sections. The field strength even changes sign. The curves for the various distances 24 intersect at a point at which the field strength is approximately $2.5 \cdot 10^5$ A/m. Now, if a scale made of bonded ferrite having a coercive field strength corresponding to the value mentioned is located above the hairpin-shaped electrical conductor, with its surface parallel to it, it is magnetized upward, in the vertical direction to a depth of about 0.5 mm, and this is done over a length corresponding to center-to-center distance 14. Beside distance 14, the magnetic field strength in the area near the surface of the scale with a width of less than 1 mm is large enough to magnetize it here in the opposite direction. To magnetize the next section of the scale, which after it is completed, is supposed to be magnetized in a periodically alternating direction, the position of the system with the hairpin-shaped electrical conductor 11 is shifted by exactly 1 mm to the right side, using a precise measurement system. The direction of the current pulse which then follows, and thus also that of the magnetic field, is opposite that of the first one. Thus, the next section of the scale is magnetized vertically downward. The areas near the surface of this section were already magnetized in this direction during the first pulse, so that it is unnecessary to reverse the direction of the magnetization that is already present. Also, in the area near the surface of the first magnetized section there is once again a field strength which exceeds the coercive field strength of the material. However, it coincides with the direction of the magnetization that is written there. Thus, no remagnetization is necessary. Thus, the lengths of the magnetized areas and also their magnetization value are reproducible with great accuracy if a highly accurate positional measurement process is used for setting the position between the scale and the shaped electrical conductor 11.

The cross sections 17.2 and 17.3 shown in FIG. 4 for hairpin-shaped electrical conductor 11 are advantageous if there are larger separations 14 between the lines going back and forth. They keep the field strengths from being reduced to excessively small values in the middle between the lines going back and forth.

Figure 5:
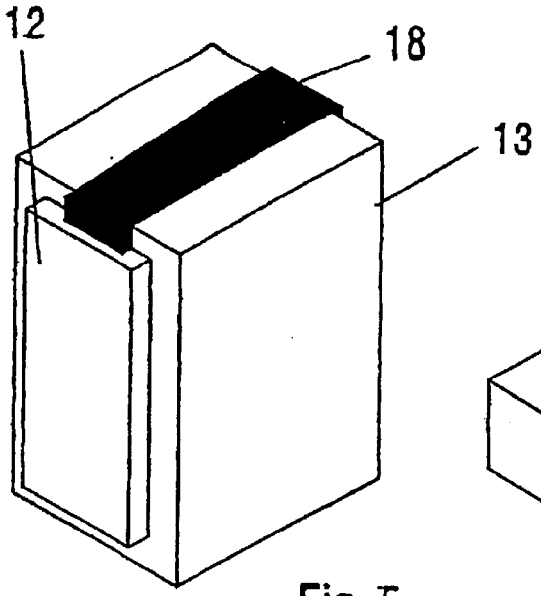
FIG. 5 is a band-shaped electrical conductor with holder.
Figure 6:
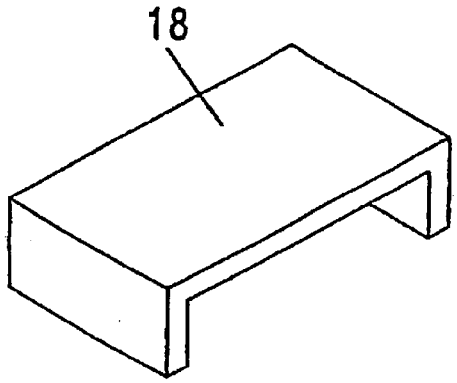
FIG. 6 is a band-shaped electrical conductor.
Figure 7:
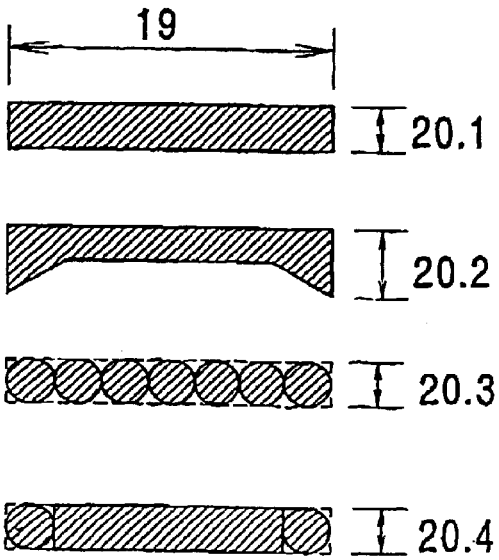
FIG. 7 is a cross section of band-shaped electrical conductor.

To write scales which should be magnetized parallel to the surface of the scale, it turns out to be advantageous to use the shaped electrical conductors shown in FIGS. 5, 6, and 7. FIG. 5 shows supply line 12 and shaped electrical conductor 18 fixed on a holder 13. FIG. 6 makes it clear that this shaped electrical conductor is band-shaped, with its width 19 being substantially greater than its thickness. FIG. 7 shows different possibilities for realizing the cross section of band-shaped electrical conductor 18. The thickness distribution 20.1 and 20.3 provides uniform field strength, beneath the band and over most of its width 19, of the field component pointing parallel to the band. A uniform field strength of the component mentioned beneath the electrical conductor all the way to the edge and a strong gradient directly adjacent to the edge is achieved with cross section 20.2 and cross section 20.4 for the case in which the wire diameter is greater than the thickness of the band located between the two wires. Thus, the scale sections can be magnetized with great accuracy.

A system for writing magnetic scales using the pulse process that is built according to the features of the invention has only about 1/100 the mass and volume of the prior art systems, its connected electrical load is reduced to 1/100, its pulse repetition rate and thus the efficiency when writing scales is increased by a factor of 100, and the accuracy of the scales obtained has been improved by more than ten fold. In addition, the new system does away with the necessity of health protection measures.

System for Writing Magnetic Scales

Key to Reference Numbers in Figures

1 Shaped electrical conductor
2 Source of current pulses
3 Capacitor bank
4 Change-over switch
5 Control unit
6 Capacitor
7 Switches
8 Operating voltage connection
9 Control unit connection
10 Shield
11 Hairpin-shaped electrical conductor
12 Supply line
13 Holder
14 Center-to-center distance
15 Dimension of cross section
16 Dimension of cross section
17 Cross section
17.1 Round cross section
17.2 Rectangular cross section with two round leads
17.3 Rectangular cross section with four round leads
18 Band conductor
19 Width of band conductor
20.1 Thickness of band conductor
20.2 Thickness distribution of band conductor
20.3 Thickness of a compound band conductor
20.4 Thickness of a compound band conductor
21 Behavior of field at a distance of 0.05 mm
22 Behavior of field at a distance of 0.2 mm
23 Behavior of field at a distance of 0.4 mm
24 Distance from shaped electrical conductor

What is claimed is:

1. A system for writing magnetic scales provided with components comprising a shaped electrical conductor (1) for producing a magnetic field on the site of the scale, and of a source of current pulses (2) for both current directions comprising a capacitor bank (3), a change-over switch (4), and a control unit (5), characterized in that the shaped electrical conductor is comprised of a conductor or conductor loop with dimensions adapted to the size of a magnetization area to be written having a uniformly set magnetization, that the change-over switch has MOS transistors arranged as an H bridge, and that the components are integrated in a rigid unit that is so compact that the current passed through the change-over switch increases to its maximum value through the shaped electrical conductor in less than a microsecond.

2. The system according to claim 1, characterized in that the compact structure makes the current path between the capacitor bank (3) and the shaped electrical conductor (1) has a resistance of less than 50 mΩ, and that the operating voltage of the system is in the low-voltage range.

3. The system according to claim 2, characterized in that the shaped electrical conductor (1) for producing a magnetic field on the site of the scale has a conductor cross section that is significantly smaller than the cross section of the supply lines (12) from the capacitor bank (3) all the way to the shaped electrical conductor (1).

4. The system according to claim 3, characterized in that the shaped electrical conductor (1) is hairpin-shaped and has a cross section (17) whose dimensions are substantially smaller than the center-to-center distance (14) of the lines running back and forth.

5. The system according to claim 4, characterized in that the cross section (17) is a circle (17.1).

6. The system according to claim 5, characterized in that the circle diameter is 0.3 mm and the center-to-center distance (14) of the lines running back and forth is 1 mm.

7. The system according to claim 4, characterized in that the cross section (17) is rectangular and that this rectangular cross section (17) is occupied by two or more round wires (17.1, 17.2), with the individual hairpin-shaped wires being electrically connected in series.

8. The system according to claim 3, characterized in that the shaped electrical conductor (1) consists of a rectangle and has a cross section whose dimensions are substantially smaller than the length and width of the rectangle.

9. The system according to claim 8, characterized in that the cross section is a circle.

10. The system according to claim 8, characterized in that the cross section is rectangular and that this rectangular cross section is occupied by two or more round wires, with the individual rectangular wires being electrically connected in series.

11. The system according to claim 3, characterized in that the shaped electrical conductor (1) consists of a band conductor (18) whose width (19) is substantially greater than its thickness (20.1).

12. The system according to claim 3, characterized in that the shaped electrical conductor (1) consists of a band conductor whose width is substantially greater than its thickness (20.2), with its thickness (20.2) being greater at the two edges than in the middle.

13. The system according to claim 3, characterized in that the shaped electrical conductor (1) consists of a number of directly adjacent wires (20.3).

14. The system according to claim 3, characterized in that the shaped electrical conductor (1) consists of a band conductor and two wires which lie symmetrically directly adjacent to the band conductor and that the three components (20.4) are electrically connected in series.

15. The system according to one of claims 3 through 14, characterized in that the shaped electrical conductor (1) is fixed in a holder (13).

16. The system according to claim 15, characterized in that the shaped electrical conductor (1) with its holder (13) is interchangeable.

17. The system according to claim 1, characterized in that each switch (7) consists of several parallel MOS transistors.

18. The system according to claim 17, characterized in that the switches (7) can be closed by the control unit (5) after a short pulse duration of a few microseconds.

19. The system according to claim 1, characterized in that the capacitor bank (3) consists of electrolytic capacitors (6).

20. The system according to claim 19, characterized in that the charge of the capacitor bank (3) is diminished by only a small proportion with each individual pulse.

21. The system according to claim 20, characterized in that the small proportion is 5%.

22. The system according to claim 21, characterized in that the maximum current pulse frequency is 50 $s^{-1}$.

23. The system according to claim 1, characterized in that the supply current of the system is less than 500 mA for pulse currents of under 2,000 A.

24. The system according to claim 1, characterized in that the source of current pulses (2) is located in a shield (10).

25. The system according to claim 1, characterized in that the mechanical construction is rigid enough that the forces of the current pulse do not put the position of the shaped electrical conductor (1) out of adjustment with respect to the scale.

26. Use of the system according to one of claims 1 through 25, characterized in that scales are made with periodic magnetization in the measurement direction.

27. Use of the system according to one of claims 1 through 25, characterized in that scales are made with magnetization areas of a length assigned to a code.

28. Use of the system according to one of claims 1 through 25, characterized in that the shaped electrical conductor (1) passes over the scale without making contact.

* * * * *